US008795776B2

(12) United States Patent
Pietsch

(10) Patent No.: US 8,795,776 B2
(45) Date of Patent: Aug. 5, 2014

(54) METHOD FOR PROVIDING A RESPECTIVE FLAT WORKING LAYER ON EACH OF THE TWO WORKING DISKS OF A DOUBLE-SIDE PROCESSING APPARATUS

(75) Inventor: Georg Pietsch, Burghausen (DE)

(73) Assignee: Siltronic AG, Munich (DE)

( * ) Notice: Subject to any disclaimer, the term of this patent is extended or adjusted under 35 U.S.C. 154(b) by 0 days.

(21) Appl. No.: 13/349,639

(22) Filed: Jan. 13, 2012

(65) Prior Publication Data

US 2012/0189777 A1 Jul. 26, 2012

(30) Foreign Application Priority Data

Jan. 21, 2011 (DE) ..... 10 2011 003 006

(51) Int. Cl.
*B05D 3/12* (2006.01)
*B24B 37/00* (2012.01)
*H01L 21/304* (2006.01)

(52) U.S. Cl.
USPC ..... 427/289

(58) Field of Classification Search
CPC ..... B24B 37/00; B24B 37/04; B24B 37/08; B24B 37/12; B24B 37/24; B24B 37/28; B24B 37/245; B24B 53/017; B24B 53/02; B24B 53/095; B24B 53/12; H01L 21/304
USPC ..... 427/289
See application file for complete search history.

(56) References Cited

U.S. PATENT DOCUMENTS 5,958,794 A 9/1999 Bruxvoort et al.
6,299,514 B1 10/2001 Boller
7,101,258 B2 9/2006 Ising
7,367,867 B2 5/2008 Boller
2003/0054650 A1 3/2003 Wenski et al.
(Continued)

FOREIGN PATENT DOCUMENTS

CN 101722447 A 6/2010
DE 1114720 B 10/1961
(Continued)

OTHER PUBLICATIONS

T. Fletcher et al., Conditioning method development for 3M™ Trizact™ Diamond Tile fixed abrasives used in the finishing of brittle substrates, Optifab, Rochester, New York, May 2, 2005, p. 1-3.

*Primary Examiner* — Kelly M Gambetta
(74) *Attorney, Agent, or Firm* — Leydig, Voit & Mayer, Ltd.

(57) ABSTRACT

A method provides a respective flat working layer on each of two working disks of a double-side processing apparatus including a ring-shaped upper working disk, a ring shaped lower working disk and a rolling apparatus that are rotatably mounted about an axis of symmetry of the double-side processing apparatus. The method includes applying a lower intermediate layer and upper intermediate layer on respective surfaces of the lower and upper working disks. Then, simultaneous leveling of both intermediate layers is performed by moving trimming apparatuses on cycloidal paths over the intermediate layers using the rolling apparatus and the respective outer toothing under pressure and with addition of a cooling lubricant, so as to provide a material removal from the intermediate layers. A lower working layer of uniform thickness is then applied to the lower intermediate layer and an upper working layer of uniform thickness is applied to the upper intermediate layer.

13 Claims, 4 Drawing Sheets

(56) References Cited

U.S. PATENT DOCUMENTS

| | | | | |
|---|---|---|---|---|
| 2003/0060138 | A1 | 3/2003 | Hasegawa et al. | |
| 2008/0014839 | A1* | 1/2008 | Pietsch et al. | 451/41 |
| 2008/0233840 | A1* | 9/2008 | Pietsch et al. | 451/41 |
| 2010/0099337 | A1 | 4/2010 | Kerstan et al. | |

FOREIGN PATENT DOCUMENTS

| | | | |
|---|---|---|---|
| DE | 10007390 | A1 | 10/2000 |
| DE | 19937784 | A1 | 2/2001 |
| DE | 10046893 | A1 | 1/2002 |
| DE | 102004040429 | A1 | 2/2006 |
| DE | 102006037490 | A1 | 2/2008 |
| DE | 102007013058 | A1 | 9/2008 |
| GB | 901742 | A | 7/1962 |
| JP | 2003077870 | A | 3/2003 |
| JP | 2005335016 | A | 12/2005 |
| JP | 2006502013 | A | 1/2006 |
| JP | 2007268679 | A | 10/2007 |
| JP | 2008245166 | A | 10/2008 |
| WO | 03103959 | A1 | 12/2003 |

* cited by examiner

METHOD FOR PROVIDING A RESPECTIVE FLAT WORKING LAYER ON EACH OF THE TWO WORKING DISKS OF A DOUBLE-SIDE PROCESSING APPARATUS

CROSS REFERENCE TO RELATED APPLICATIONS

This application claims priority to German Patent Application No. DE 10 2011 003 006.9, filed Jan. 21, 2011, which is hereby incorporated by reference herein in its entirety.

FIELD OF THE INVENTION

The present invention relates to a method for providing a respective flat working layer on each of the two working disks of a double-side processing apparatus comprising a ring-shaped upper working disk, a ring-shaped lower working disk and a rolling apparatus, wherein the two working disks and also the rolling apparatus are mounted in a manner rotatable about the axis of symmetry of the double-side processing apparatus

BACKGROUND

Electronics, microelectronics and microelectromechanics require as starting materials semiconductor wafers with extreme requirements made of global and local flatness, single-side-referenced flatness (nanotopology), roughness and cleanness. Semiconductor wafers are wafers composed of semiconductor materials such as elemental semiconductors (silicon, germanium), compound semiconductors (for example composed of an element of the third main group of the periodic table such as aluminum, gallium or indium and an element of the fifth main group of the periodic table such as nitrogen, phosphorus or arsenic) or the compounds thereof (for example $Si_{1-x}Ge_x$, $0 \leq x \leq 1$).

Semiconductor wafers are typically produced by means of a multiplicity of successive process steps which can generally be classified into the following groups:

(a) producing a usually monocrystalline semiconductor rod;
(b) slicing the rod into individual wafers;
(c) mechanical processing;
(d) chemical processing;
(e) chemomechanical processing;
(f) if appropriate producing layer structures.

In the production of semiconductor wafers for particularly demanding applications, advantageous sequences in this case include sequences which comprise at least one processing method in which both sides of the semiconductor wafers are simultaneously processed in material-removing fashion in one processing step by means of two working surfaces, to be precise in such a way that the processing forces acting on the semiconductor wafer on the front and rear sides during the material removal substantially compensate for one another and no constraining forces are exerted on the semiconductor wafer by a guide apparatus, that is to say that the semiconductor wafer is processed in "free floating" fashion.

In the prior art, preference is given to sequences in which both sides of at least three semiconductor wafers are simultaneously processed in material-removing fashion between two ring-shaped working disks, wherein the semiconductor wafers are inserted loosely into receiving openings of at least three guide cages (carriers) toothed on the outside, which are guided by means of a rolling apparatus and the outer toothing under pressure on cycloidal paths through the working gap formed between the working disks, such that in this case they can rotate completely around the midpoint of the double-side processing apparatus. Methods that employ rotating carriers and process both sides of a plurality of semiconductor wafers simultaneously in material-removing fashion over the whole area in this way include double-side lapping ("lapping"), double-side polishing (DSP) and double-side grinding with planetary kinematics ("planetary pad grinding", PPG). Of these, in particular DSP and PPG are of particular importance. In contrast to lapping, the working disks in the case of DSP and in the case of PPG additionally each comprise a working layer, the mutually facing sides of which constitute the working surfaces. PPG and DSP are known in the prior art and will be described briefly below.

"Planetary pad grinding" (PPG) is a method from the group of mechanical processing steps which brings about a material removal by means of grinding. It is described for example in DE102007013058A1, and an apparatus suitable therefor is described for example in DE19937784A1. In the case of PPG, each working disk comprises a working layer containing bonded abrasive. The working layers are present in the form of structured grinding pads which are fixed on the working layers adhesively, magnetically, in a positively locking manner (for example hook and loop fastener) or by means of vacuum. The working layers have a sufficient adhesion on the working disk in order not to be displaced, deformed (formation of a bead) or detached during processing. However, they can easily be removed from the working disks by means of a peeling movement and can therefore rapidly be exchanged, such that, without long set-up times, it is possible to change rapidly between different types of grinding pad for different applications. Suitable working layers in the form of grinding pads designed to be self-adhesive on the rear side are described for example in U.S. Pat. No. 5,958,794. The abrasive used in the grinding pads is preferably diamond.

Double-side polishing (DSP) is a method from the group of chemomechanical processing steps. DSP processing of silicon wafers is described for example in US2003/054650A and an apparatus suitable therefor is described in DE10007390A1. In this description, "chemical mechanical polishing" should be understood exclusively to mean a material removal by means of a mixed effect, comprising chemical etching by means of an alkaline solution and mechanical erosion by means of loose grain dispersed in the aqueous medium, which is brought into contact with the semiconductor wafer by a polishing pad, which contains no hard substances that come into contact with the semiconductor wafer, and thus brings about a material removal from the semiconductor wafer under pressure and relative movement. In the case of DSP, the working layers are present in the form of polishing pads, and the latter are fixed on the working disks adhesively, magnetically, in a positively locking manner (for example hook and loop fastener) or by means of vacuum. The alkaline solution preferably has a pH value of between 9 and 12 during chemical mechanical polishing, and the grain dispersed therein is preferably a colloidally disperse silica sol having grain sizes of the sol particles of between 5 nm and a few micrometers.

What is common to PPG and DSP is that the flatness and parallelism of the working surfaces directly determine the obtainable flatness and parallelism of the semiconductor wafer processed by them. For PPG this is described in DE DE102007013058A1. For particularly demanding applications, particularly stringent requirements made of the plane-parallelism of the semiconductor wafer and thus of the plane-parallelism of the working surfaces are applicable.

The flatness of the working surface is firstly critically determined by the flatness of the working disk which carries the working layer. The following methods are known for making the working disks of double-side processing apparatuses as flat as possible:

By way of example, turning of the working disk blank by means of chip removal by a turning tool is known. The face turning is preferably effected after the working disk has been mounted in the double-side processing apparatus, since subsequent mounting can strain or deform the working disk again. Alternatively, the working disk can also be processed prior to mounting on a correspondingly larger processing apparatus for example by lapping toward planarity and then has to be mounted in a manner exhibiting particularly low strain. What is common to all of the known measures, however, is that they can admittedly improve the flatness of the working disk, but not to the extent that would be necessary for the production of semiconductor wafers for particularly demanding applications.

The parallelism of the working surfaces with respect to one another is likewise firstly critically determined by the parallelism of the working disks each carrying a working layer. The following methods are known for making the working disks of double-side processing methods as parallel as possible to one another:

Firstly, one working disk, preferably the lower one, which is generally mounted rigidly in the double-side processing apparatus, is made as flat as possible by turning after incorporation or by lapping on a separate processing apparatus before incorporation into the double-side processing apparatus. Then, the other working disk, preferably the upper one, which is generally mounted cardanically and can thereby at least globally on average always be oriented parallel to the lower working disk, is incorporated into the double-side processing apparatus and lapped in against the lower working disk. Preceding face turning of the upper working disk in a separate processing apparatus is conceivable; however, in that case, it is necessary, finally, for the two working disks, after incorporation into the double-side processing apparatus, to be lapped against one another in order to remove the processing traces of turning or the offsets from the multiple changing or redressing of the turning tool that is necessary owing to the large chipping volume.

Since the working disks finally always have to be lapped, at the end of the leveling process they have a convex profile and their surfaces facing one another therefore run parallel to one another only to an insufficient extent.

The prior art discloses possibilities for ensuring that a best possible plane-parallelism of the working surfaces—once it has been established—is maintained even under thermal and mechanical cyclic loading. A particularly stiff working disk with good cooling is described for example in DE10007390A1. Possibilities for actively setting the working disk form are disclosed for example in DE102004040429A1 or DE102006037490A1. However, these methods for the targeted deformation of the working disks during processing are unsuitable for making an initially uneven working disk flat to an extent such that the working surface of a working layer applied on the working disk has the flatness and parallelism of both working surfaces with respect to one another as required for the production of semiconductor wafers for particularly demanding applications.

Finally, the flatness of the working surfaces and the parallelism of both working surfaces with respect to one another are determined by the thickness profile of the working layers applied to the working disks. The working layer can, if it is highly constant in its thickness and elastic, at best simulate the form of the working disk.

Finally, the prior art discloses methods for trimming the working layer. Trimming is understood to mean the targeted material removal from a tool. A distinction is made between shaping trimming ("truing") and trimming that alters the surface properties of the tool ("dressing", "conditioning", "seasoning"). In the case of shaping trimming, material is removed from the tool with the aid of suitable trimming apparatuses in such a way that a desired target form of the elements of the tool which come into contact with the workpieces arises. In contrast thereto, in the case of trimming that only alters the surface properties of the tool, so little material is removed that the desired property change, for example roughening, cleaning or redressing, is just achieved, but a critical change in the form of the tool is avoided in the process.

In the case of DSP, however, shaping trimming of the working layers (polishing pads) cannot be carried out since the useful layer of a polishing pad is extremely thin. The useful layer is so thin because the polishing pad is subject to practically no material-removing wear in the course of its use. Since shaping trimming cannot be carried out in the case of DSP, an unevenness of the working surface resulting from an uneven working disk cannot be corrected.

In the case of PPG, the working layer (grinding pad), by means of the abrasive bonded in it, enters into engagement with the semiconductor wafer and brings about the material removal under pressure and with relative movement. The grinding pad is therefore subject to wear. Since the PPG grinding pad is subject to wear, its useful layer generally has a considerable thickness (at least a few tenths of a millimeter), and so economic use without frequent production interruptions caused by changing the grinding pad is possible and its flatness can be reestablished by repeated trimming. In the prior art, directly after a new grinding pad has been applied, trimming is carried out in order to expose abrasive grain at the working surface (initial dressing). One method for initial dressing is described for example in T. Fletcher et al., Optifab, Rochester, N.Y., May 2, 2005.

Both initial dressing by itself and regular trimming for reestablishing the form of the working surface are associated with such small material removals from the working layer that this does not significantly shorten the service life of the grinding pad.

In principle, in the case of PPG, in contrast to DSP, it is possible to trim the working layer by means of considerably lengthened shaping trimming such that a flat working surface is obtained even on an uneven working disk such as cannot be produced better in the prior art. In this case, however, a considerable portion of the initial useful layer height of material has to be removed from the grinding pad, for example more than one third. This makes the described method uneconomic (high consumption of expensive grinding pad, high consumption of the trimming blocks, lengthy trimming process with long outage of the installation).

SUMMARY

An aspect of the present invention is to provide improved flatness and plane-parallelism of the working layers of a double-side processing apparatus for DSP or PPG, without requiring a considerable material removal by shaping trimming of the working layer.

In an embodiment, the present invention provides a method that provides a respective flat working layer on each of two working disks of a double-side processing apparatus including a ring-shaped upper working disk, a ring shaped lower working disk and a rolling apparatus. Each of the working disks and the rolling apparatus are rotatably mounted about an axis of symmetry of the double-side processing apparatus. The method includes applying a lower intermediate layer on a surface of the lower working disk and an upper intermediate layer on a surface of the upper working disk. Then, simultaneously leveling of both intermediate layers is performed using at least three trimming apparatuses, each trimming apparatus including a trimming disk, at least one trimming body including an abrasive substance, and an outer toothing. The leveling includes moving the trimming apparatuses on cycloidal paths over the intermediate layers using the rolling apparatus and the respective outer toothing under pressure and with addition of a cooling lubricant that is free of substances having an abrasive action, so as to provide a material removal from the intermediate layers. A lower working layer of uniform thickness is then applied to the lower intermediate layer and an upper working layer of uniform thickness is applied to the upper intermediate layer.

BRIEF DESCRIPTION OF THE DRAWINGS

Exemplary embodiments of the present invention are described in more detail below with reference to the drawings, in which.

DESCRIPTION OF THE INVENTION

In an embodiment, the present invention provides a method for providing a respective flat working layer on each of the two working disks of a double-side processing apparatus comprising a ring-shaped upper working disk, a ring-shaped lower working disk and a rolling apparatus, wherein the two working disks and also the rolling apparatus are mounted in a manner rotatable about the axis of symmetry of the double-side processing apparatus, and wherein the method comprises the following steps in the stated order:

(a) applying a lower intermediate layer on the surface of the lower working disk and an upper intermediate layer on the surface of the upper working disk;

(b) simultaneously leveling both intermediate layers by means of at least three trimming apparatuses, each comprising a trimming disk, at least one trimming body containing an abrasive substance, and an outer toothing, wherein the trimming apparatuses are moved by means of the rolling apparatus and the outer toothing under pressure and with addition of a cooling lubricant, which contains no substances with abrasive action, on cycloidal paths over the intermediate layers and thus bring about a material removal from the intermediate layers; and (c) applying a lower working layer of uniform thickness to the lower intermediate layer and an upper working layer of uniform thickness to the upper intermediate layer.

The method according to embodiments of the invention is able to provide highly flat working surfaces without necessitating shaping trimming. Therefore, the method can also be employed in the case of DSP, where shaping trimming of the working layer is not possible on account of the small thickness thereof. In the case of PPG, it is possible to avoid a considerable reduction of the thickness and hence of the possible service life of the working layer that is associated with shaping trimming.

DETAILED DESCRIPTION OF THE INVENTION

The invention is described in detail below with reference to figures and exemplary embodiments.

Figure 5:
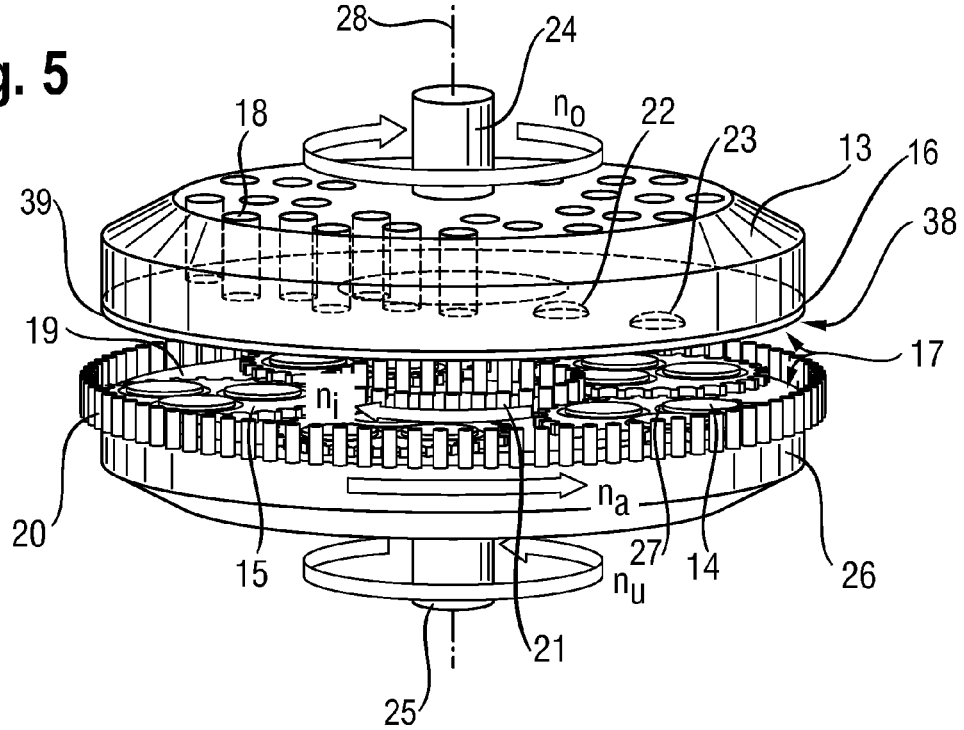
FIG. 5 is a schematic illustration of elements of a double-side processing apparatus in accordance with the prior art.

FIG. 5 shows elements of an apparatus for the simultaneous material-removing processing of both sides of a plurality of semiconductor wafers with rotating carriers, to which embodiments of the present invention relates: an upper, ring-shaped working disk 13 and a lower working disk 26 rotate on collinear axes 24 and 25 with rotational speeds no and nu. An inner pin wheel 21 is arranged within the internal diameter of the ring-shaped working disks 13 and 26 and an outer pin wheel 20 is arranged outside the external diameter of the ring-shaped working disks 13 and 26, said pin wheels rotating at rotational speeds ni and na collinearly with respect to the working disks and hence about the common overall axis 28 of the double-side processing apparatus. Inner 21 and outer pin wheels 20 form a rolling apparatus, into which are inserted at least three carriers 15 with an appropriate outer toothing. FIG. 5 shows a double-side processing apparatus into which five carriers 15, for example, are inserted. The carriers 15 each have at least one, but preferably a plurality of openings 27 for receiving semiconductor wafers 14. In the example shown in FIG. 5, three semiconductor wafers 14 are respectively inserted into each of the five carriers. In this example, therefore, fifteen semiconductor wafers 14 are processed simultaneously per processing pass (machine batch).

According to an embodiment of the invention, the two working disks 13 and 26 carry intermediate layers (upper intermediate layer 16 in FIGS. 5, 7 and lower intermediate layer 29 in FIG. 7) on their surfaces facing one another. The mutually facing surfaces of the intermediate layers carry working layers (upper working layer 39 in FIG. 5 and lower working layer 32 in FIG. 7). The mutually facing surfaces of the working layers 39 and 32 form the working surfaces 38 and 19. The latter come into contact with the front and rear sides of the semiconductor wafers 14 during processing.

By means of the rolling apparatus 20, 21 and the outer toothing, the carriers 15 with the semiconductor wafers 14 are guided on cycloidal paths simultaneously over the upper 38 and the lower working surface 19. What is characteristic of the double-side processing apparatus shown in this case is that the carriers in this case rotate on planetary paths about the axis 28 of the entire apparatus. That space which is formed between the working surfaces 38 and 19 and in which the carriers move in this case is designated as working gap 17. During processing, the upper working disk 13 exerts a force on the lower working disk 26, and an operating medium is fed via channels 18 in the upper working disk 13.

If the double-side processing apparatus shown in FIG. 5 is used for chemical mechanical double-side polishing, the working layers 39 and 32 are polishing pads containing no hard substances with abrasive action which come into contact with the surfaces of the semiconductor wafers 14 during processing. The operating medium fed to the working gap 17 via the channels 18 is a polishing agent, which preferably contains a colloidally disperse silica sol having a pH value of between 9 and 12.

If the double-side processing apparatus shown in FIG. 5 is used for double-side grinding according to the PPG principle, the working layers 39 and 32 are grinding pads containing fixedly bonded abrasive substances in contact with the surfaces of the semiconductor wafers 14. The operating medium fed to the working gap 17 via the channels 18 is a cooling lubricant containing no substances with abrasive action. Preferably, pure water without further additives is used as the cooling lubricant in the case of PPG.

The material removal is finally brought about by the described relative movement of the semiconductor wafers 14 with respect to the working layers 39 and 32. In the case of DSP, the material removal is effected by means of a three-body interaction of (1) polishing pad, (2) silica sol comprising reactive OH— groups of the alkaline polishing agent and (3) surface of the semiconductor wafer 14 facing the respective polishing pad. In the case of PPG, the material removal is effected by means of a two-body interaction of (1) grinding pad having bonded abrasive and (2) surface of the semiconductor wafer 14 facing the respective grinding pad.

The form of the working gap 17 formed between the working surfaces 38 and 19 critically determines the form of the semiconductor wafers 14 processed in said gap. A gap profile that is as parallel as possible yields semiconductor wafers 14 having highly plane-parallel front and rear sides. By contrast, a radially gaping or azimuthally undulatory ("wobbling") gap yields a poor plane-parallelism of front and rear sides, for example in the form of a wedge shape of the thickness or undulation of the semiconductor wafer surface. Therefore, some double-side processing apparatuses have sensors 22 and 23 which are arranged at different radial positions in the upper working disk 13, for example, and which measure the distance between the mutually facing surfaces of the working disks 13 and 26 during processing.

The measurement of the distance between the working disks 13 and 26 indirectly permits conclusions about the distance between the working surfaces 38 and 19, which bring about the material removal from the semiconductor wafers 14 and are therefore critical. From this—at least indirectly and given knowledge of the thickness of the working layers 39 and 32, for example because the latter are subject to a constant and hence predictable wear—the thickness of the semiconductor wafers 14 can be deduced. This permits a targeted final turn-off when the target thickness of the semiconductor wafers 14 is obtained.

Furthermore, the use of a plurality of sensors 22 and 23 arranged at different radial positions additionally permits conclusions about the radial profile and—with good temporal resolution of the distance measurement and an absolute angle encoding of the rotational angles of the two working disks—at least in principle also about the azimuthal profile of the working gap 17. Some double-side processing apparatuses are therefore additionally equipped with actuating elements which bring about a deformation of the working gap—usually only in a radial direction (gape) and with a defined one-parameter characteristic—for example by the deformation of a working disk. If this deformation according to the measured distance is effected continuously in a closed control loop, a largely parallel working gap can be set and can be kept constant even under a thermal and mechanical cyclic load during processing.

FIG. 7 elucidates the partial steps of a method according to an embodiment of the invention which are required for the preparation of a uniform working gap.

In step (a), an upper intermediate layer 16 and a lower intermediate layer 29 are applied (FIG. 7 (B)) to the uneven upper working disk 13 and lower working disk 26 (FIG. 7 (A)). The intermediate layers 16, 29 applied preferably have a certain degree of elasticity in order to be able to follow the form of the respective working disk, in order to form a positively locking composite. Since they follow the form of the working disk, their mutually facing surfaces 40 and 30 are just as uneven as the surfaces of the working disks 13 and 26.

A plastic is preferably chosen for the intermediate layers. Plates composed of plastic are available even in large dimensions and with good dimensional accuracy and can easily be processed in material-removing fashion. The intermediate layers can also be composed of a plurality of plates by means of uninterrupted parqueting. Possible initial differences in thicknesses at the abutting edges of the individual "tiles" are removed by the trimming step, thus resulting in a homogeneous covering. Plastics are generally poor heat conductors. The heat transfer from the working gap, in which the semiconductor wafers move later, into the working disk, which is generally pervaded by a cooling labyrinth and thus brings about dissipation of the resultant processing heat, takes place over the entire surface, however, such that the heat conduction is still sufficient even after the intermediate layer has been applied. Plastics having an increased thermal conductivity are preferably used for the intermediate layer. These are generally filled with graphite (carbon black) or else aluminum, metal oxide or copper and readily available.

Preferred plastics for the intermediate layers are polyamide (PA), acetal (polyoxymethylene, POM), acrylic (polymethyl methacrylate, PMMA; acrylic glass), polycarbonate (PC), polysulfone (PSU), polyether ether ketone (PEEK), polyphenylene sulfide (PPS), polyethylene terephthalate (PET) or polyvinyl chloride (PVC). Thermosetting plastics such as epoxy resin (EP), polyester resin (UP), phenolic resin or non-elastomeric polyurethanes (PU) are particularly preferred. A glass or carbon fiber reinforced epoxy resin (GFRP-EP, CFRP-EP) is also especially preferred. As a result of the fiber reinforcement it is dimensionally stable, but with thin thicknesses it is sufficiently elastic to follow the contour of the uneven working disk and to enable a positively locking composite. The thermosetting plastics specified can be processed well by means of chip-removing processing, in particular filled or fiber-reinforced epoxy resins. They can also be permanently bonded to the working disk particularly well. In the case of adhesive bonding using epoxy resin, the curing is effected by means of polyaddition. Therefore, no low molecular weight byproducts such as, for example, water from a polycondensation occur, and there is no need for solvents to escape, which would be greatly delayed by the intermediate layer covering the adhesive joint.

The bonding of the intermediate layer 16, 29 to the working disk 13, 26 is preferably produced by permanent bonding. Whenever a new working layer 32, 39 is mounted, which, after all, is subject to wear and therefore has to be changed regularly, the intermediate layer is intended to remain as a carefully prepared, very flat reference surface permanently on the working disk.

In the next step (b), simultaneous shaping trimming of both intermediate layers 16 and 29 is carried out by means of at least three trimming apparatuses, each comprising a trimming disk 34 (see FIG. 6), at least one trimming body 35, 36 and an outer toothing 37, wherein the trimming apparatuses are moved by means of the rolling apparatus 20, 21 and the outer toothing 37 under pressure and with addition of a cooling lubricant, which contains no substances with abrasive action, on cycloidal paths over the intermediate layers 16, 29 and thus bring about a material removal from the intermediate layers 16, 29.

Figure 6:
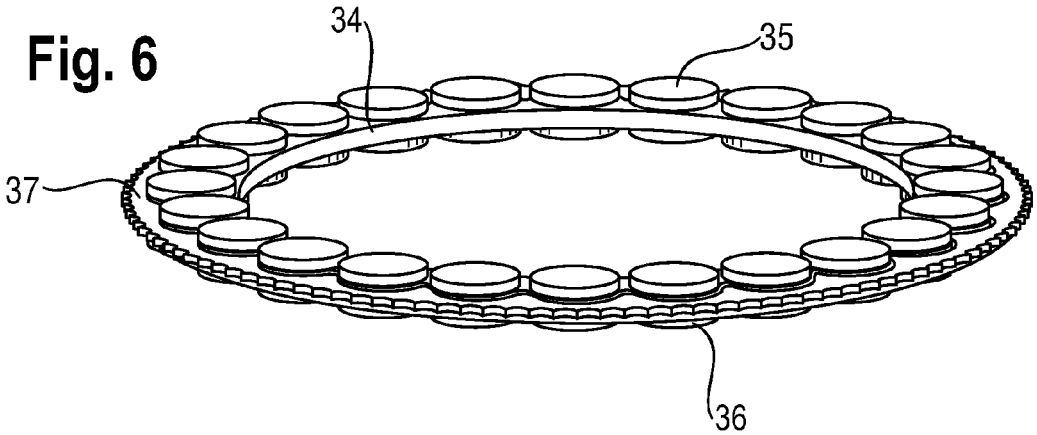
FIG. 6 shows an exemplary embodiment of a trimming apparatus for leveling the intermediate layer according to the method according to the invention.
Figure 7A:
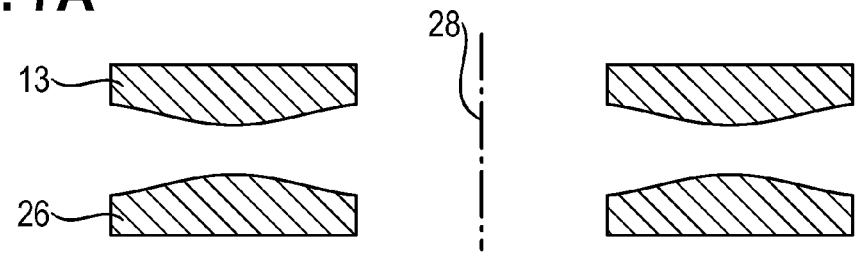
FIG. 7 is a schematic illustration of steps a) to d) of a method according to an embodiment of the invention.
Figure 7B:
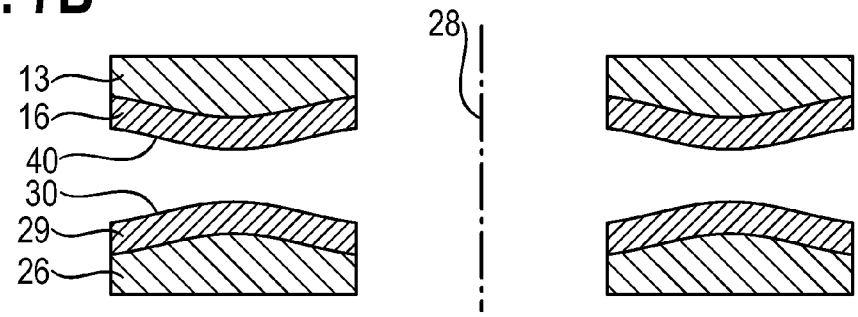
Figure 7C:
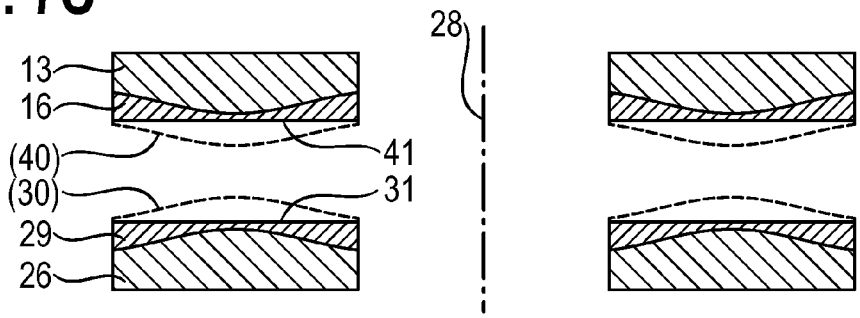
Figure 7D:
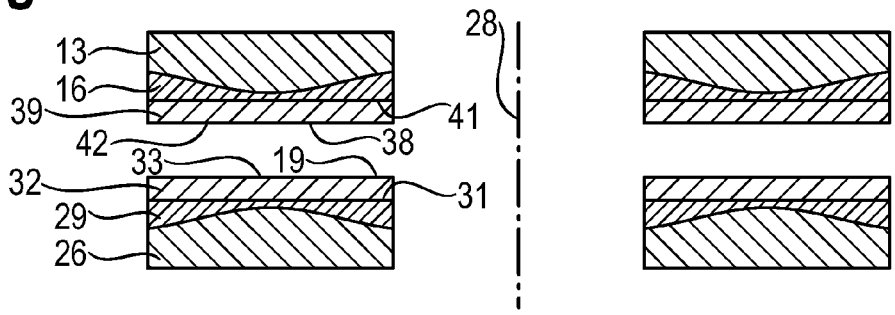

A trimming apparatus as shown schematically in FIG. 6 is suitable for the shaping trimming of the intermediate layer. The trimming apparatus comprises a trimming disk 34, at least one trimming body 35, 36 and an outer toothing 37. The trimming disk 34 serves as a carrier, on which the at least one trimming body 35 is applied. However, the trimming apparatus can also be embodied from one piece. In this case, trimming disk 34 and trimming bodies 35, 36 are identical and the trimming body 35, 36 thus passes simultaneously into engagement with both intermediate layers applied on the working disks of the double-side processing apparatus. The outer toothing 37 is then fixed to it or integrated into it. Preferably, however, a suitable trimming apparatus consists of the individual elements, as shown in FIG. 6. The trimming disk 34 then carries at least one upper trimming body 35 and at least one lower trimming body 36, which come into engagement with the upper and lower intermediate layers. In the case of respectively precisely one upper trimming body 35 and precisely one lower trimming body 36, these are preferably ring-shaped.

The trimming can be carried out by means of trimming bodies 35 and 36 which, in contact with the intermediate layer, release abrasive substances and thus bring about a material removal from the intermediate layer with loose grain. This differs from lapping, which, after all, likewise brings about a material removal with loose grain, crucially by virtue of the fact that the material-removing grain is released and works directly at the active location. The disadvantages of lapping, namely a convex form of the lapped workpieces (here: the intermediate layer) on account of lapping agent depletion during transport from the edge to the center of the workpiece, is avoided in this way. Therefore, the intermediate layer cannot be leveled by trimming by means of lapping with grain supplied. It is also not possible for the trimming by means of the trimming apparatus described to be carried out directly on the working disks and for the application of an intermediate layer thus to be avoided, since the trimming apparatuses bring about no material removal from the materials of which the working disk consists—preferably cast steel (ductile gray cast iron or cast stainless steel)—or wear very rapidly and thereby lose their form.

In this case of trimming with released grain, the abrasive preferably contains aluminum oxide ($Al_2O_3$), silicon carbide (SiC), zirconium dioxide ($ZrO_2$), boron nitride (BN), boron carbide ($B_4C$), quartz ($SiO_2$) or cerium dioxide ($CeO_2$) or mixtures of the substances mentioned.

The trimming of the intermediate layer can also be carried out according to an embodiment of the invention by means of trimming bodies 35 and 36 which contain fixedly bonded abrasive in contact with the intermediate layer and thus bring about a material removal with fixedly bonded grain. This trimming, too, cannot be used for directly trimming the uneven working disk itself since the abrasive fixedly bonded in the trimming bodies 35 and 36 is preferably diamond or silicon carbide (SiC), particularly preferably diamond. Diamond is not suitable for the processing of steels. Diamond has a high solubility for carbon, which, after all, is what diamond consists of. In contact with steel, the cutting edges of diamond are immediately rounded and the trimming bodies become blunt.

When the intermediate layer is trimmed with fixedly bonded grain, the turning bodies preferably comprise so-called diamond "pellets". "Pellets" are generally understood to be a series of uniform bodies having at least two side surfaces which run in plane-parallel fashion with respect to one another, for example cylinders, hollow cylinders or prisms, which contain the abrasive with synthetic resin, by means of sintering and baking (ceramic or vitreous bonding) or in metallically bonded fashion. Particularly preferably, when the intermediate layer is trimmed, a PPG grinding pad is also used as trimming body, said grinding pad being adhesively bonded onto the trimming disk 34 on both sides (FIG. 6). The PPG grinding pads were originally developed for the material-removing processing of glass (optics) and are therefore particularly well suited to the effective processing of glass fiber-filled epoxy resin having a high proportion of glass.

In order, when the intermediate layers 16, 29 have been applied, to further improve the heat conduction from the working gap 17 to the working disks 13, 26, preferably during the shaping trimming of the intermediate layers so much material is removed that the respective intermediate layer just still covers the highest elevations of the relevant working disk at the end of the trimming process. At all events, after trimming the intermediate layer is intended to still completely cover the entire working disk to which it is applied, that is to say that the intention is for no perforations to occur. A value at which the thickness remaining after trimming at the thinnest location is a maximum of one tenth of the remaining thickness of the thickest location of the intermediate layer has proved to be practicable. In the case of a working disk having an unevenness with an amplitude of approximately 20 μm (FIG. 2), it therefore suffices if the intermediate layer is only a few micrometers thick at the thinnest locations after trimming. Such a thin intermediate layer then no longer impairs the heat conduction at all.

Extremely good flatnesses can be produced by means of the trimming described. FIG. 7 (C) shows the flat surfaces 41 and 31 thus obtained of the upper 16 and lower intermediate layer 29 on the underlying uneven working disks 13 and 26.

FIG. 7 (D) shows the arrangement comprising the uneven working disks 13 and 26 with the leveled intermediate layers 16 and 29 and the working layers 39 and 32—applied finally in step (c)—with the working surfaces 38 and 19 facing one another. Owing to the flatness of the intermediate layers 16 and 29, the working layers 39, 32 also already have very flat working surfaces 42, 33 directly after application. They are suitable without further trimming measures for the processing of semiconductor wafers for particularly demanding applications.

Optionally, however, a non-shaping trimming of the working layers 39 and 32 can additionally be carried out in step (d). The trimming methods described for step (c) can likewise be used for this purpose.

In the case of a polishing pad for the DSP method, by way of example, a non-shaping trimming (conditioning, dressing) may be necessary in order to perform fine smoothing. A maximum permissible removal of 1/10 of the initial thickness of the available useful layer of the working layer has proved to be practical. In the case of a polishing pad for the DSP method, the useful layer height is only a few 10 μm to a maximum of approximately 200 μm. Therefore, only preferably less than approximately 5 μm, particularly preferably however only 1-3 μm, should be removed. Preferably, the trimming bodies 35, 36 in this case contain a fixedly bonded abrasive substance, such that they bring about a material removal from the working layers by means of bonded grain. The preferred abrasive substances for this application are diamond and silicon carbide (SiC).

On the other hand, a non-shaping trimming may also be necessary in order to perform initial dressing in the case of a grinding pad for the PPG method. In the case of the initial dressing, a few micrometers of the topmost layer of the grinding pad are removed in order to uncover cutting-active abrasive. In the case of a PPG grinding pad, the useful layer thickness is approximately 600 μm, for example. Trimming of at most 10 to 12 μm, particularly preferably however only 4 to 6 μm, can be rated as non-shaping. In general, therefore, in the case of a PPG grinding pad, less than 1/50 of the initial useful layer thickness is removed. Preferably, in this case, the trimming bodies 35, 36 release abrasive substance upon contact with the working layers, such that a material removal from the working layers is brought about by means of loose grain. In this case, the trimming bodies contain at least one of the following substances: aluminum oxide ($Al_2O_3$), silicon carbide (SiC), zirconium dioxide ($ZrO_2$), boron nitride (BN), boron carbide ($B_4C$).

Example and Comparative Example

A double-side processing apparatus of the AC2000 type from Peter Wolters GmbH (Rendsburg, Germany) was used for the example and the comparative example. The ring-shaped working disks of the apparatus have an external diameter of 1935 mm and an internal diameter of 563 mm. The ring width is therefore 686 mm.

Figure 1:
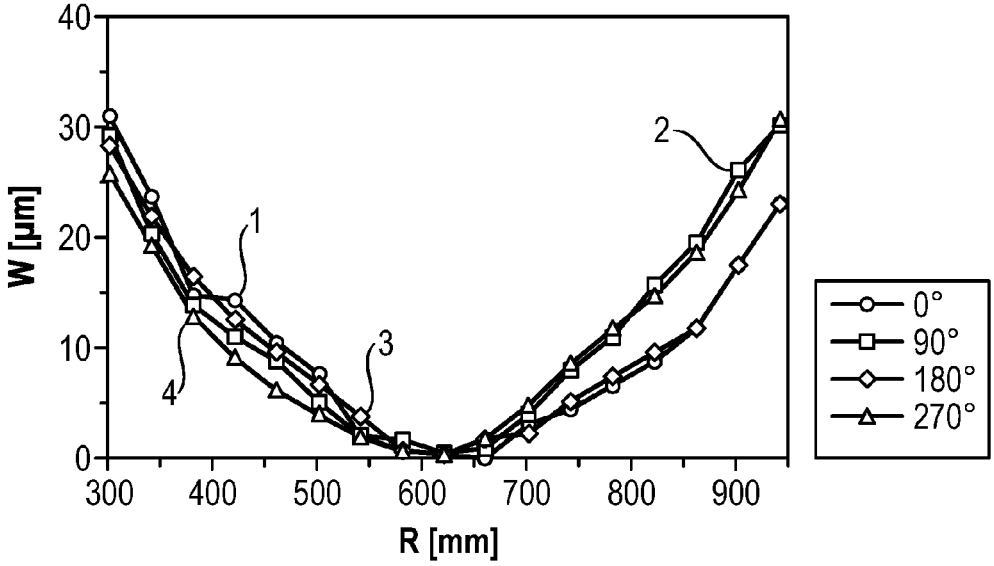
FIG. 1 shows a radial profile of the distance between the working disks.

FIG. 1 shows the profile W=W(R) of the distance W (in micrometers) between the mutually facing surfaces of the working disks of the double-side processing apparatus as a function of the working disk radius R (in millimeters). For the distance measurement, the upper working disk was mounted onto three gage blocks positioned at 120° on the lower working disk. The gage blocks were situated on identical radii, which were chosen such that the flexure of the upper working disk under gravitational force when supported onto these three bearing points became approximately minimal. These points of an annular plate correspond to the so-called Bessel or Airy points onto which a bending beam with uniform line load has to be placed onto two points in order that it has a minimum flexure over its entire length.

The radial profile of the working disk distance was measured by means of a distance dial gage. The AC2000 has an apparatus for adjusting the radial form of the upper working disk. The form can be set between convex and concave relative to the lower working disk. The setting that produced a radial profile of the gap between the working disks that was as uniform as possible was used. FIG. 1 shows the resultant radial profiles of the working disk distance for four different angles of rotation (azimuth) of the upper relative to the lower working disk (curve 1 for 0°, curve 2 for 90°, curve 3 for 180° and curve 4 for 270°) with a constant measurement track on the lower working disk. On account of the dimensions of the dial gage (bearing feet), only the radial range of $302.5 \leq R \leq 942.5$ was accessible to a measurement. Therefore, 640 mm of the ring having an overall width of 686 mm was measured.

The plate form shown was obtained by lapping in accordance with the prior art. It can clearly be seen in FIG. 1 that the distance between the working disks varies principally in a radial direction. It is largest at the outer and at the inner radius and smallest approximately at half the ring width. This corresponds to a decrease in the working disk thickness at the inner and at the outer edge such as is characteristic of lapping processing. The smaller azimuthal deviation (different profiles W(R) 1 and 3 relative to 2 and 4 particularly at large radii R>700) indicates a strain of the working disks along a bend line running diametrically through the axis 28 of symmetry of the apparatus.

Figure 2:
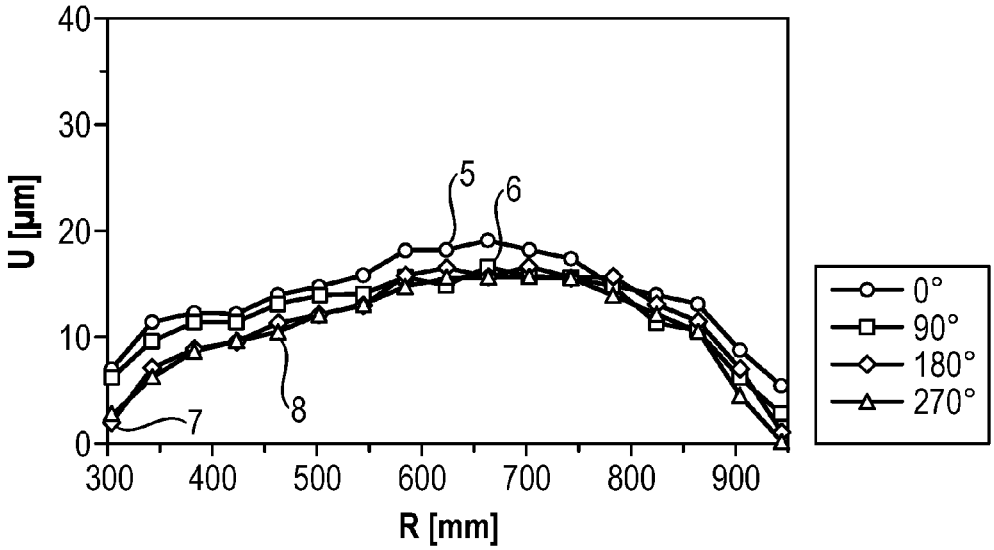
FIG. 2 shows a radial profile of the form of the lower working disk.

FIG. 2 shows the profile U=U(R) of the height U (in micrometers) of the lower working disk of the same apparatus as a function of the working disk radius R (in millimeters). For the measurement, a flexurally stiff steel ruler was placed diametrically over the lower working disk onto two gage blocks arranged at the Bessel points and the distance between that surface of the lower working disk which faces the ruler and the ruler was determined by means of a dial gage for different radii. The measurements were carried out at the same angles (azimuth) as the measurement of the working disk distance W(R) as shown in FIG. 1 (curve 5 at 0°, curve 6 at 90°, curve 7 at 180° and curve 8 at 270°). The lower working disk has a decrease in its height toward the outer and inner edges and has its largest thickness ("bulge") at a radius of somewhat larger than half the ring width.

The upper working disk is mounted movably (cardanically) and therefore not accessible to a direct measurement of its form by means of the ruler method. However, its form results directly from the difference between the profiles W(R) (FIG. 1) and U(R) (FIG. 2). The maximum of the height difference in FIG. 2 is approximately 17 μm and the maximum of the distance difference in FIG. 1 is approximately 32 μm. The gap between the ring-shaped working disks that gapes to the outer and inner edges is therefore distributed approximately uniformly between upper and lower working disks, which have approximately an identical "bulge" in the ring center.

Comparative Example

In the comparative example, a PPG grinding pad of the 677XAEL type from 3M as working layer was adhesively bonded directly onto each of the working disks—characterized by FIG. 1 and FIG. 2—of the double-side processing apparatus described. It consists of a 0.76 mm thick underlying support layer, with which the pad is adhesively bonded on the intermediate layer and a 0.8 mm thick upper layer, of which a maximum of 650 μm can be used as a useful layer. The two grinding pads were leveled by means of a trimming method in which on average in each case approximately 60 μm of material was removed from the upper and from the lower grinding pad. Trimming apparatuses in a similar method as described for the trimming of the intermediate layer in the example hereinafter were used for this purpose. The trimming was carried out in the case of a setting of the apparatus for adjusting the radial form of the upper working disk for which previously, between the working disks not subjected to adhesive bonding, the maximally uniform radial profile of the gap between the working disks had been measured ("optimum working point").

Figure 3:
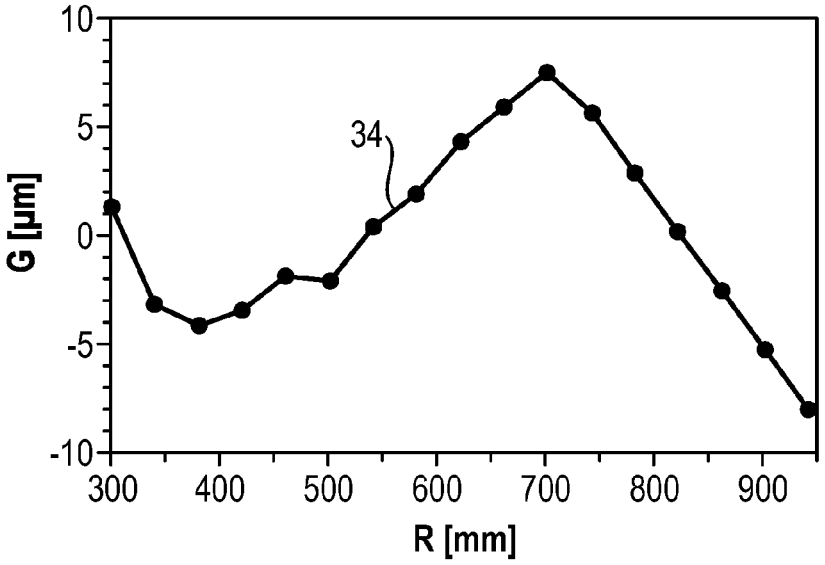
FIG. 3 shows a radial profile of the distance between the working surfaces after preparation by a method not according to the invention.

FIG. 3 shows the profile G=G(R) of the distance G between the two working surfaces after trimming. The distance G denotes the width of the working gap 17 in FIG. 5.

The material removal of on average in each case approximately 60 μm achieved during trimming is far more than would have been required for a non-shaping trimming for initial dressing (exposure of abrasive grain), but evidently still too little to obtain a uniform gap G(R)=const.: although the non-uniformity of the distance W=W(R) of the working disks (FIG. 1; approximately 32 μm) was able to be reduced, with an amplitude of approximately 17 μm it is still much too large to be able to obtain thereby semiconductor wafers having plane-parallelisms of their surfaces that are suitable for demanding applications. FIG. 3 only shows the gap profile 34 for 0°. The azimuthal non-uniformity of the gap was largely eliminated, such that the radial non-uniformity predominates and a gap profile 34 for one angle completely describes the entire working gap.

If the working layer applied had been a polishing pad, the material removal of approximately 60 μm of material as a result of the trimming would have already made the polishing pad unusable since the useful thickness of a polishing pad is only a few 10 μm—and a uniform working gap would nevertheless not have been obtainable.

Example

The working disks characterized by the unevennesses illustrated in FIGS. 1 and 2 were adhesively bonded in quadrants with 0.5 mm thick glass fiber reinforced epoxy resin plates cut to size in ring-segment-shaped fashion from plate blanks having a size of 1000×1000 $mm^2$. This is a plastic that is very well suited to carrying out a method according to an embodiment of the invention. It is readily available in large dimensions, with good dimensional accuracy and with constant quality, since GFRP-EP is used in large quantities as a standard material in the production of electronic printed circuit boards. The adhesive bonding was firstly effected by means of a 50 μm thick unsupported, highly adhesive synthetic resin adhesive layer, such that in the event of failure the applied intermediate layer could have been removed again without residues. The adhesive layer is held by a protective film and was bonded to the cut-to-size epoxy resin plates with heat and under pressure (ironing). After the protective film had been stripped away, the GFRP cut-to-size pieces were therefore configured in self-adhesive fashion and were thus adhesively bonded to the working disk. A good force-locking and positively locking bond between working disk and intermediate layer was obtained by subsequent manual rolling.

Trimming apparatuses of the type illustrated in FIG. 5 were used for leveling the intermediate layers thus applied. Each of the trimming apparatuses comprised a ring-shaped trimming disk 34 composed of 15 mm aluminum, a ring-shaped outer toothing 37 composed of 6 mm stainless steel that is screwed thereto and engages into the rolling apparatus formed from inner and outer pin wheels of the double-side processing apparatus, and cylindrical abrasive bodies 35, 36 adhesively bonded onto the trimming disk in a number of 24 on the front side and 24 on the rear side and having a diameter of 70 mm and a height of 25 mm and composed of high-grade corundum pink, which are arranged uniformly on a pitch circle having a diameter of 604 mm. Four trimming apparatuses of this type were inserted into the double-side processing apparatus in a uniformly distributed manner.

The trimming was effected with a downforce of the upper working disk of 400 daN and rotation of upper and lower working disks in opposite directions of approximately 30/min (revolutions per minute) relative to the trimming apparatuses, which revolved at approximately 1/min in the processing apparatus and rotated at approximately 6/min about their own respective axes. The trimming was again carried out at the optimum working point (maximally uniform working gap before the adhesive bonding of the intermediate layers). The trimming of the intermediate layers was effected in a plurality of partial removals in order to be able to check the removal success in the meantime and to measure the flatness achieved. The epoxy resin plates had previously been provided with small openings at a plurality of locations, through which it was possible to sense the underlying working disk using a measuring apparatus and thus to determine the residual thickness of the epoxy resin plate. At the end of the trimming process, the thinnest location accessible to any measurement was still just under 100 μm, and the actually thinnest location was estimated at 50 μm. This corresponds to the thickness of a glass fiber layer (50 μm). Therefore, even at its thinnest locations, the intermediate layer is still stable and is also not detached or deformed when the working layer is changed, in the course of which, after all, tensile forces occur (stripping away of the working layer by means of a peeling movement).

After the leveling of the intermediate layers, a PPG grinding pad of the 677XAEL type from 3M as working layer was in turn adhesively bonded onto each of the two intermediate layers.

Initial dressing was finally performed. On account of the excellent planarity already after mounting onto the highly flat intermediate layer, material removal of approximately 10 μm sufficed for dressing all "tiles" in all regions of the grinding pad. This was checked by means of color markings which had been applied in scattered fashion at various locations of the pad surface before trimming and had all been removed uniformly after trimming. For the initial dressing, the trimming apparatuses were used in a similar method as described above for the trimming of the intermediate layer. Finally, the working surfaces were cleaned by intensive rinsing of loose residual corundum.

Figure 4:
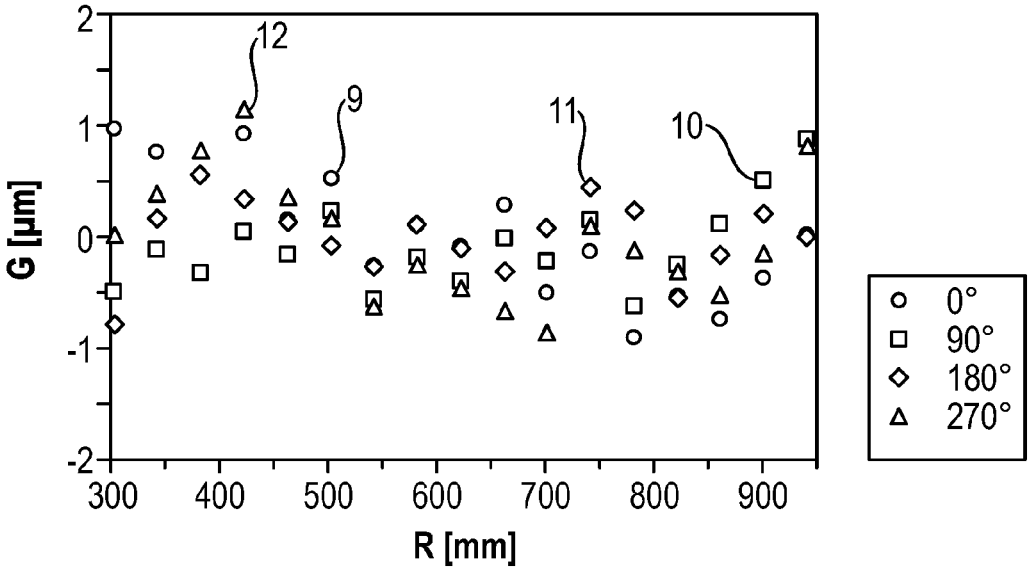
FIG. 4 shows a radial profile of the distance between the working surfaces after preparation by the method according to an embodiment of the invention.

FIG. 4 shows the radial profile of the width G (in micrometers) of the working gap between the mutually facing working surfaces of the working layers prepared in this way. Over the radial range accessible to the measurement of 640 mm of the total ring width of 686 mm, the width of the working gap varies only by ±1 μm. The measurement was obtained after deformation of the upper working disk to an optimally uniform working gap and mounting of the upper working disk on three gage blocks placed on the lower working disk. The measurement accuracy of this method is approximately ±1 μm and results from the accuracy of the bearing of the foot, which has to be large enough to bear securely on a plurality of the tiles into which the grinding pad is structured and which have a size of a plurality of square millimeters, and the sensing of the opposite working surface by means of a measurement sensor, which likewise has to bear securely on a plurality of tiles, and also the measurement accuracy of the dial gage itself.

Five carriers each having three openings with a total of 15 semiconductor wafers having a diameter of 300 mm inserted therein were inserted into the double-side processing apparatus prepared according to an embodiment of the invention and a control pass was performed. Despite the small material removal during initial dressing, the working layer exhibited the occurring grinding forces and material removal rates familiar from preliminary experiments without a leveled intermediate layer and with considerably increased shaping initial trimming (150 μm removal). The control pass was performed with the setting of the best possible parallelism of the working disks with respect to one another, said setting being known from calibration curves. The form of the working disks was readjusted during the pass, i.e. kept constant under the thermal and mechanical cyclic loads occurring. The processed semiconductor wafers had a flatness of approximately 1 μm TTV.

Finally, it has been found that primarily the parallelism of the working surfaces that process the semiconductor wafer in material-removing fashion with respect to one another is critical for the obtainable flatness of the semiconductor wafer. It emerged that it suffices if the individual working surfaces are in this case flat only in short-wave fashion; they are permitted to be deformed in long-wave fashion as long as they only have working surfaces parallel to one another at each angular position. In this case, "short-wave" should be understood to mean lengths that are greater than those lengths above which the semiconductor wafers can be deformed on account of their finite stiffness, but which are significantly smaller than the dimensions of the semiconductor wafer; "long-wave" should be understood to mean lengths which are significantly greater than the diameter of the semiconductor wafers through to the diameter of the double-side processing apparatus (one to two meters).

The structuring of a PPG grinding pad in the form of a multiplicity of regularly arranged "tiles" and "trenches" having an extent of a few millimeters in each case therefore does not adversely affect the obtainable flatness since the semiconductor wafers, on the millimeter scale, on account of their stiffness, cannot adapt to the form of a working surface structured in this way. On account of the rotational symmetry of the double-side processing apparatuses suitable for carrying out a method according to an embodiment of the invention, therefore, the intermediate layers can be slightly curved radially symmetrically with respect to the axis of rotation, that is to say for example one working surface concave and the other working surface convex in a manner exactly complementary thereto. In practice, working layers spherically curved approximately in opposite directions (spherical shells) are usually obtained during trimming. As long as the maximum difference in the deviation from a flat form over the entire working layer is less than 50 μm, semiconductor wafers are obtained having the same plane-parallelism of their surfaces as by processing with perfectly plane-parallel working surfaces.

While the invention has been particularly shown and described with reference to preferred embodiments thereof, it will be understood by those skilled in the art that various changes in form and details may be made therein without departing from the spirit and scope of the invention.

LIST OF REFERENCE SYMBOLS AND ABBREVIATIONS

1 Radial profile of the distance between the working disks in the case of 0° azimuth (method not according to the invention)
2 Radial profile of the distance between the working disks in the case of 90° azimuth (method not according to the invention)
3 Radial profile of the distance between the working disks in the case of 180° azimuth (method not according to the invention)
4 Radial profile of the distance between the working disks in the case of 270° azimuth (method not according to the invention)
5 Radial profile of the form of the lower working layer in the case of 0° azimuth (method not according to the invention)
6 Radial profile of the form of the lower working layer in the case of 90° azimuth (method not according to the invention)
7 Radial profile of the form of the lower working layer in the case of 180° azimuth (method not according to the invention)
8 Radial profile of the form of the lower working layer in the case of 270° azimuth (method not according to the invention)
9 Radial profile of the working gap between the working surfaces in the case of 0° azimuth (method according to the invention)
10 Radial profile of the working gap between the working surfaces in the case of 90° azimuth (method according to the invention)
11 Radial profile of the working gap between the working surfaces in the case of 180° azimuth (method according to the invention)
12 Radial profile of the working gap between the working surfaces in the case of 270° azimuth (method according to the invention)
13 Upper working disk
14 Semiconductor wafer
15 Carrier
16 Upper intermediate layer
17 Working gap between the working surfaces
18 Channels for feeding liquid operating medium
19 Lower working surface
20 Outer pin wheel
21 Inner pin wheel
22 Apparatus for measuring the gap width between the surfaces of the working disks near the inner circumference
23 Apparatus for measuring the gap width between the surfaces of the working disks near the outer circumference
24 Axis of rotation of the upper working disk
25 Axis of rotation of the lower working disk
26 Lower working disk
27 Opening in the carrier for receiving a semiconductor wafer
28 Axis of rotation and symmetry of the entire double-side processing apparatus
29 Lower intermediate layer
30 Surface of the lower intermediate layer before leveling
31 Surface of the lower intermediate layer after leveling
32 Lower working layer
33 Flat working surface of the lower working layer after preparation by the method according to the invention
34 Trimming disk
35 Upper trimming body
36 Lower trimming body
37 Outer toothing of the trimming apparatus
38 Upper working surface
39 Upper working layer
40 Surface of the upper intermediate layer before leveling
41 Surface of the upper intermediate layer after leveling
42 Flat working surface of the upper working layer after preparation by the method according to the invention
W Distance between the mutually facing surfaces of the working disks
U Height (thickness) of the lower working disk
G Distance between the working surfaces
R Radial position on the working disk
no Rotational speed of the upper working disk
nu Rotational speed of the lower working disk
ni Rotational speed of the inner pin wheel
na Rotational speed of the outer pin wheel

What is claimed is:

1. A method for providing a respective flat working layer on each of two working disks of a double-side processing apparatus including a ring-shaped upper working disk, a ring shaped lower working disk and a rolling apparatus, with each of the working disks and the rolling apparatus being rotatably mounted about an axis of symmetry of the double-side processing apparatus, the method comprising each of the following steps in the stated order:

(a) applying a lower intermediate layer on a surface of the lower working disk and an upper intermediate layer on a surface of the upper working disk, wherein a composition of the working layers is different from a composition of the intermediate layers;

(b) simultaneously leveling both intermediate layers using at least three trimming apparatuses, each trimming apparatus including a trimming disk, at least one trimming body including an abrasive substance, and an outer toothing, the leveling including moving the trimming apparatuses on cycloidal paths over the intermediate layers using the rolling apparatus and the respective outer toothing under pressure and with addition of a cooling lubricant that is free of substances having an abrasive action, so as to provide a material removal from the intermediate layers; and (c) applying a lower working layer of uniform thickness to the lower intermediate layer and an upper working layer of uniform thickness to the upper intermediate layer.

2. The method as recited in claim 1, wherein the intermediate layers are plastic.

3. The method as recited in claim 1, wherein the simultaneous leveling includes releasing abrasive substance from the at least one trimming body upon contact with the intermediate layers so as to provide, loose grain for the material removal from the intermediate layers.

4. The method as recited in claim 3, wherein the abrasive substance of the at least one trimming body includes at least one of aluminum oxide (Al2O3), silicon carbide (SiC), zirconium dioxide (ZrO2), boron nitride (BN), boron carbide (B4C), quartz (SiO2), cerium dioxide (CeO2).

5. The method as recited in claim 1, wherein the at least one trimming body includes a fixedly bonded abrasive substance such that the simultaneous leveling includes material removal from the intermediate layers using fixedly bonded grain.

6. The method as recited in claim 5, wherein the fixedly bonded abrasive substance includes at least one of diamond and silicon carbide.

7. The method as recited in claim 1, wherein step (b) includes retaining a portion of each intermediate layer such that the working disks remain completely covered by the respective intermediate layers, and a minimum thickness of each remaining intermediate layer is no greater than 1/10 of a maximum thickness of the respective remaining intermediate layer.

8. The method as recited in claim 1, wherein the working layers include polishing pads configured for chemical mechanical polishing of semiconductor wafers and are free of abrasive substances.

9. The method as recited in claim 8, wherein after step (c), the method further comprising:

(d) simultaneously trimming each working layer using at least three trimming apparatuses each including a trimming disk, at least one trimming body having a fixedly bonded abrasive substance, and an outer toothing, the simultaneous trimming including moving the trimming apparatuses on cycloidal paths over the working layers using the rolling apparatus and the respective outer toothing under pressure and with addition of a cooling lubricant that is free of abrasive action so as to remove material from the working layers by a bonded grain, the removal of material being less than 1/10 of a usual layer thickness of the respective working layer.

10. The method as recited in claim 9, wherein the abrasive substance in the at least one trimming body includes at least one of diamond and silicon carbide.

11. The method as recited in claim 1, wherein the working layers include grinding pads configured to grind semiconductor wafers and include a fixedly bonded abrasive substance.

12. The method as recited in claim 11, wherein after step (c), the method further comprising:

(d) simultaneously trimming each working layer using at least three trimming apparatuses each including a trimming disk, at least one trimming body, and an outer toothing, the simultaneous trimming including moving the trimming apparatuses on cycloidal paths over the working layers using the rolling apparatus and the respective outer toothing under pressure and with addition of a cooling lubricant that is free of abrasive action so as to release abrasive substance upon contact with the working layers and remove material from the working layers by a loose grain, the removal of material being less than 1/50 of a useful layer thickness of the respective working layer.

13. The method as recited in claim 12, wherein the released abrasive substance includes at least one of aluminum oxide ($Al_2O_3$), silicon carbide (SiC), zirconium dioxide ($ZrO_2$), boron nitride (BN), boron carbide ($B_4C$).

* * * * *